US009055362B2

(12) United States Patent
Zhang

(10) Patent No.: US 9,055,362 B2
(45) Date of Patent: Jun. 9, 2015

(54) METHODS, APPARATUS AND SYSTEMS FOR INDIVIDUALIZING AUDIO, MUSIC AND SPEECH ADAPTIVELY, INTELLIGENTLY AND INTERACTIVELY

(71) Applicant: Duo Zhang, Carlsbad, CA (US)

(72) Inventor: Duo Zhang, Carlsbad, CA (US)

(73) Assignee: Duo Zhang, Carlsbad, CA (US)

( * ) Notice: Subject to any disclaimer, the term of this patent is extended or adjusted under 35 U.S.C. 154(b) by 283 days.

(21) Appl. No.: 13/719,251

(22) Filed: Dec. 19, 2012

(65) Prior Publication Data

US 2014/0169572 A1 Jun. 19, 2014

(51) Int. Cl.

| | |
|---|---|
| ***H04R 3/04*** | (2006.01) |
| ***H04R 5/033*** | (2006.01) |
| *H04R 1/10* | (2006.01) |

(52) U.S. Cl.
CPC .. *H04R 3/04* (2013.01); *H04R 1/10* (2013.01); *H04R 5/033* (2013.01)

(58) Field of Classification Search
CPC ..... H04N 11/00; H04R 29/00
USPC ..... 381/56, 58
See application file for complete search history.

(56) References Cited

U.S. PATENT DOCUMENTS

| | | | | |
|---|---|---|---|---|
| 8,712,076 | B2 * | 4/2014 | Dickins | 381/94.3 |
| 2006/0167784 | A1 * | 7/2006 | Hoffberg | 705/37 |
| 2007/0087756 | A1 * | 4/2007 | Hoffberg | 455/450 |
| 2013/0230184 | A1 * | 9/2013 | Kuech et al. | 381/66 |

* cited by examiner

*Primary Examiner* — Simon King

(57) ABSTRACT

The present invention discloses methods, apparatus and systems for individualizing music, audio and speech adaptively, intelligently and interactively according to a listener's personal hearing ability, unique hearing preference, characteristic feedback, and real-time surrounding environment.

12 Claims, 4 Drawing Sheets

METHODS, APPARATUS AND SYSTEMS FOR INDIVIDUALIZING AUDIO, MUSIC AND SPEECH ADAPTIVELY, INTELLIGENTLY AND INTERACTIVELY

CROSS-REFERENCE TO RELATED APPLICATIONS

NOT APPLICABLE

STATEMENT REGARDING FEDERALLY SPONSORED RESEARCH OR DEVELOPMENT

NOT APPLICABLE

FIELD OF THE INVENTION

The present invention relates generally to the fields of intelligent audio, music and speech processing. It also relates to individualized equalization curves, individualized delivery of music, audio and speech, and interactively customized music content. More particularly, the present invention relates to methods, apparatus and systems for individualizing audio, music and speech adaptively, intelligently and interactively according to a listener's personal hearing ability, unique hearing preference, characteristic feedback, and real-time surrounding environment.

BACKGROUND OF THE INVENTION

For home theaters, personal listening systems, recording studios, and other sound systems, signal processing plays a critical role. Among many signal processing techniques, equalization is commonly used to alter the amount of energy allocated in different frequency bands to make a sound more sensational, or to render said sound with new properties. When a sound engineer sets up a sound system, the system as a whole is commonly equalized in frequency domain to compensate for equipment distortion, room acoustics, and most importantly a listener's preference. Therefore, equalization is a listener-dependent task, and the best equalization relies on adaptive and intelligent individualization. Similarly, spatial audio and speech enhancement, among others, require adaptive and intelligent individualization to achieve best perceptual quality and satisfy personal hearing ability.

Currently, rapid growth of computational ability of personal listening systems increases signal processing power significantly, which makes it feasible to individualize personal sound systems by low system-level computational complexity.

SUMMARY OF THE INVENTION

Disclosed herein are methods, apparatus and systems for individualizing audio, music and speech adaptively, intelligently and interactively. One aspect of the present invention involves finding a set of parameters of a personal listening system that best fits a listener, wherein an automated test is conducted to determine the best set of parameters. During the test, the present invention characterizes personal hearing preference, hearing ability, and surrounding environment to search, optimize and adjust said personal listening system. Another aspect of the invention provides an adaptive and intelligent search algorithm to automatically assess a listener's hearing preference and hearing ability in a specific listening environment with reliable convergence. The advantages of the present invention include portability, repeatability, independency of music and speech content, and straightforward extensibility into existing personal listening systems.

DETAILED DESCRIPTION OF THE INVENTION

As used herein, the term "plurality" shall mean two or more than two. The term "another" is defined as a second or more. The terms "including" and "having" are open ended. The term "or" is interpreted as inclusive or meaning any one or any combination.

Reference throughout this document to "one embodiment", "certain embodiments", and "an embodiment" or similar terms means that a particular element, function, step, act, feature, structure, or characteristic described in connection with the embodiment is included in at least one embodiment of the present invention. Thus, the appearances of such phrases in various places are not necessarily all referring to the same embodiment. Furthermore, the disclosed elements, functions, steps, acts, features, structures, or characteristics can be combined in any suitable manner on one or more embodiments without limitation. An exception will occur only when a combination of said elements, functions, steps, acts, features, structures, or characteristics, are in some way inherently mutually exclusive.

Figure 1:
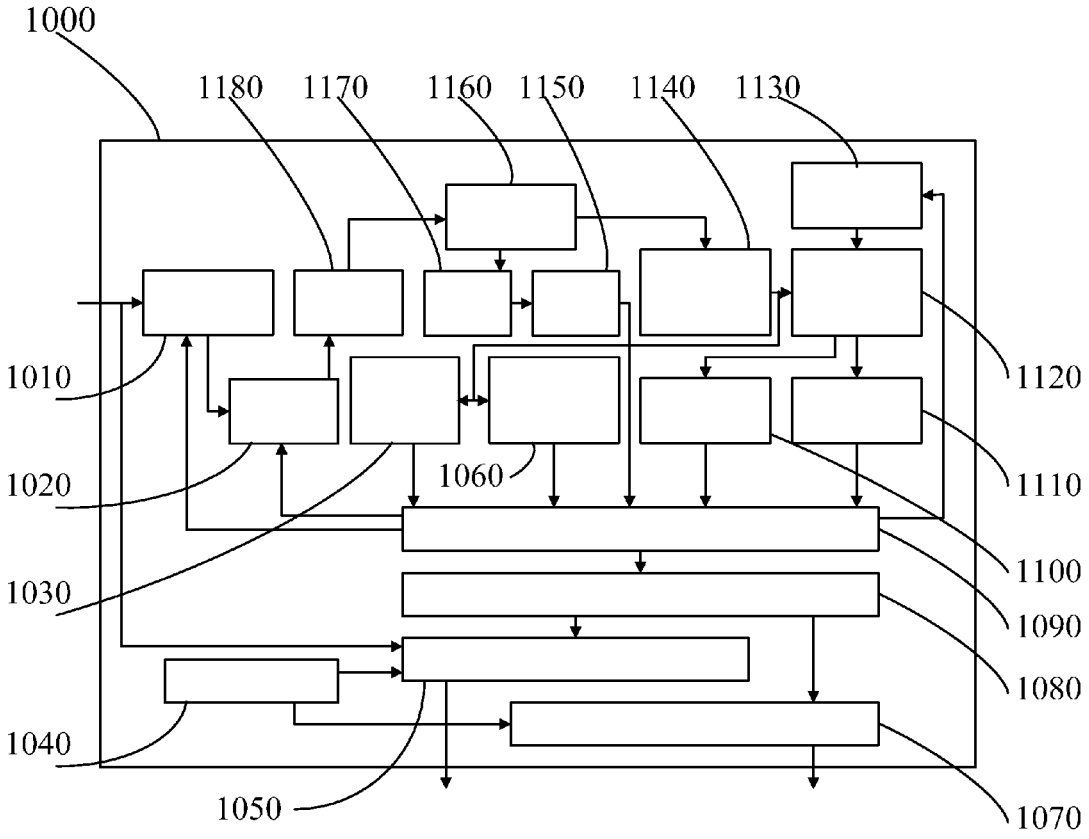
FIG. 1 is an explanatory block diagram showing an individualized personal listening system of the present invention.

In one embodiment, referring to FIG. 1, an incoming sound input is adjusted by an automatic fluctuation control unit (AFCU) 1010 before entering a windowing unit (WDU) 1020 and a zero padding unit 1180. When the output of said zero padding unit 1180 is transformed into a plurality of time-frequency bins by a forward transform unit 1160, said time-frequency bins pass a cepstrum unit 1170 to output a cepstrum. Said cepstrum is processed by at least one cepstrum-domain lifter 1150 to output a cepstrum vector into an adaptive classification unit (ACU) 1090. Additionally, the output of said forward transform unit 1160 is directed to a weighted fusion unit 1140 that merges adjacent time-frequency bins according to non-linear psychoacoustic-based auditory tuning curves. Accordingly, the output of said weighted fusion unit 1140 provides auditory system based representation of said incoming sound. Additionally, the output of said weighted fusion unit is employed by a long-term high-order moment calculation unit (LHMCU) 1030 to compute variance, skewness and kurtosis in a long-term manner. Furthermore, the output of said weighted fusion unit is also employed by a short-term high-order moment calculation unit (SHMCU) 1060 to calculate short-term variance, skewness and kurtosis. Said long-term and short-term variances, skewnesses and kurtosises are directed to the ACU 1090. The output of said weighted fusion unit passes a multi-block weighted averaging unit (MBWAU) 1120 to suppress a plurality of undesired components. Said MBWAU delivers a first output and a second output, wherein said first output is a long-term mean value 1100 and said second output is a short-term mean value 1110. Said long-term and short-term mean values are delivered to said ACU 1090. Said ACU 1090 utilizes said cepstrum vector, said long-term and short-term mean values, said long-term and short-term variances, said long-term and short-term skewnesses, and said long-term and short-term kurtosises, to classify current instantaneous signal into a beat category or a non-beat category. Said classification leads to a beat signal 1080. In parallel, said ACU 1090 adaptively updates said AFCU 1010, said WDU 1020, and a plurality of weighting coefficients 1130. Said weighting coefficients 1130 control the MBWAU 1120 to compute said long-term and short-term mean values. Said beat signal 1080 controls an individualized auditory enhancer (IAE) 1050 to enhance auditory perception in accordance to a listener's human input unit 1040. At the same time, said beat signal 1080 drives at least one individualized multimodal enhancer (IME) 1070. The IME 1070 activates at least one tactile actuator, vibrator, visual displayer, or motion controller, wherein said tactile actuator, said vibrator, said visual displayer, or said motion controller, stimulates human sensory modalities.

In broad embodiment, the present invention comprises filtering an original audio signal by manipulating a magnitude response and a phase response, assigning said phase response to compensate for a group delay according to a result of a hearing test, searching for the best set of audio parameters, and individualizing said audio adaptively and intelligently for an individual.

In another embodiment, an assessment process is added to confirm reliability of the best EQ curve chosen by testing a listener, and an evaluation result is automatically obtained in regard to reliability.

In one embodiment, said best EQ curves can be transferred to another generic equalizer so that a listener can listen to an equalized song through said generic equalizer.

In one embodiment, said best EQ curves are encoded to programmable earphones, headphones, headsets or loudspeakers so that said earphones, said headphones, said headsets or said loudspeaker becomes individualized and suitable for a plurality of music songs.

In another embodiment, a vocal separation module serves as a front end, separates audio material into a plurality of streams including a vocal stream, a plurality of instrumental streams and a background environmental stream, applies an individualized set of parameters that are obtained through a hearing test to each stream, and mixes said equalized streams together.

Figure 2:
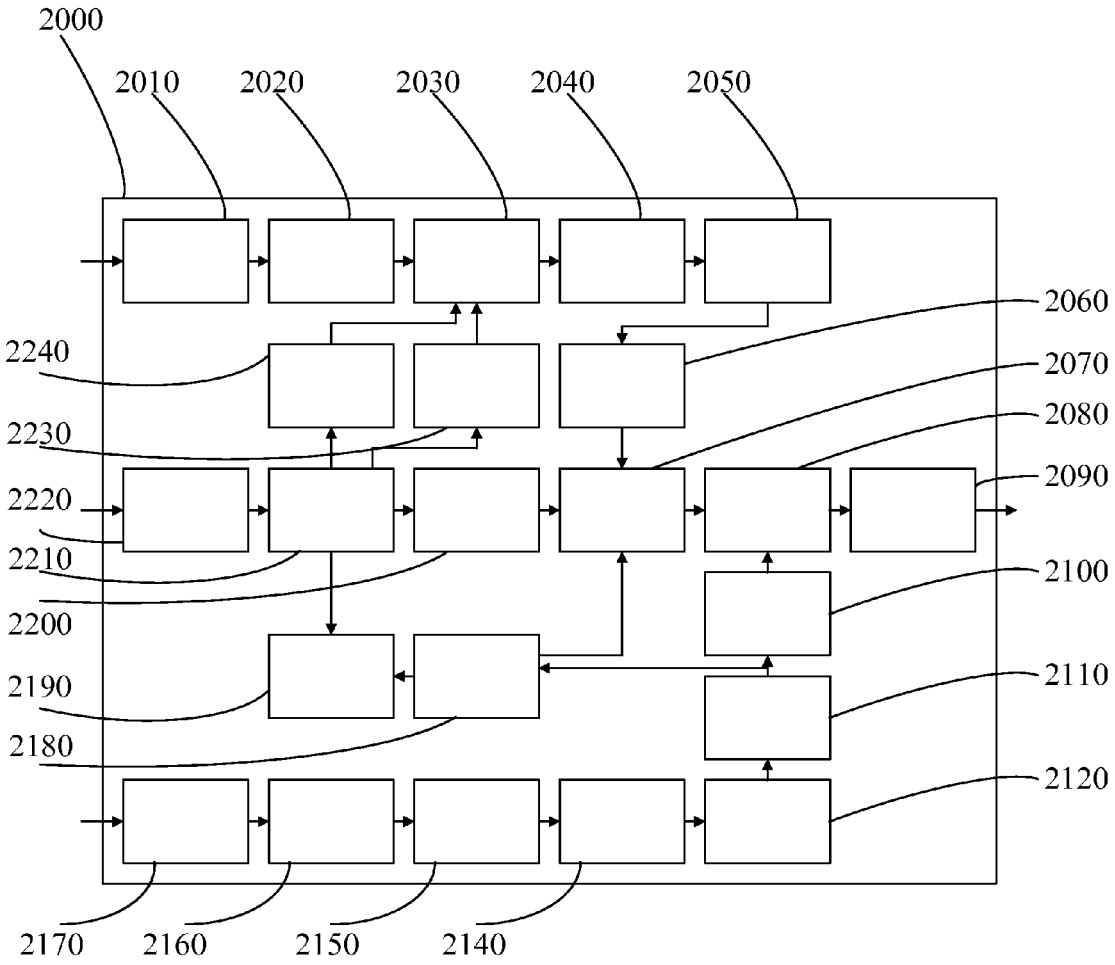
FIG. 2 is an explanatory block diagram showing a signal processing framework of an embodiment of the present invention.

In one embodiment, referring to FIG. 2, an incoming sound input is sent to an input adapting unit 2170 for adapting to quality and amplitude of said sound input. A first output of said input adapting unit 2170 is directed to a direct current removing unit 2160 to remove direct current components. A second output of said direct current removing unit 2160 is delivered to a multiplexing unit 2150 to pre-process multidimensional properties of said sound input for a forward transform. A windowing unit 2140 is applied to conduct a window function to a third output of said multiplexing unit 2150. Zeros are padded to a fourth output of said windowing unit 2140 through a first zero padding unit 2120. A forward transform is performed on a fourth output of said first zero padding unit 2120 by a first forward transform unit 2110, whereas said first forward transform unit 2110 generates a first stream. Said first stream is delivered to a beat sensing unit 2180, wherein said beat sensing unit 2180 extracts a beat signal from said first stream. Said beat signal is sent to a visual animation unit 2190, wherein said visual animation unit 2190 stimulates individual visual perception. An individual motion sensing unit 2220 is employed to detect an individual motion, wherein said individual motion unit 2220 stimulates an individual motion conversion unit 2210. A converted motion waveform is conveyed from said individual motion conversion unit 2210 to said visual animation unit 2190, a spatial data loading unit 2200, an equalization curve searching unit 2240, and a filter shaping unit 2230, wherein said spatial data loading unit 2200 loads a transformed frequency response of a spatial impulse response into a channel arranging unit 2070, said equalization curve searching unit 2240 searches for an equalization curve for an individual, and said filter shaping unit 2230 adjusts a response contour of a function combining unit 2030. A fifth output of a test result converter unit 2020 is sent to said function combining unit 2030, wherein said test result converter unit 2020 extracts a sixth output of a hearing test unit 2010. A combined stream is provided from said test result converter 2020, said equalization curve searching unit 2240, and said filter shaping unit 2030 to a first reverse transform unit 2040, wherein said first reverse transform unit 2040 conducts a reverse transform. A seventh output of said first reverse transform unit 2040 is delivered to a second zero padding unit 2050, wherein said zero padding unit adds zeros to said seventh output of said reverse transform unit 2040. A second stream is combined from said spatial data loading unit 2200, said beat sensing unit 2180, and a second forward transform unit 2060, wherein said forward transform unit 2060 conducts a forward transform on an eighth output of said zero padding unit 2050. Said second stream is delivered to a magnitude and phase manipulating unit 2080, wherein a channel separating unit 2100 converts said first stream to a plurality of channels, and said magnitude and phase manipulating unit 2080 adjusts magnitude and phase of said channels. Finally, a ninth output of said magnitude and phase manipulating unit 2080 is sent to a second reverse transform unit 2090 for auditory perception enhancement.

Figure 3:
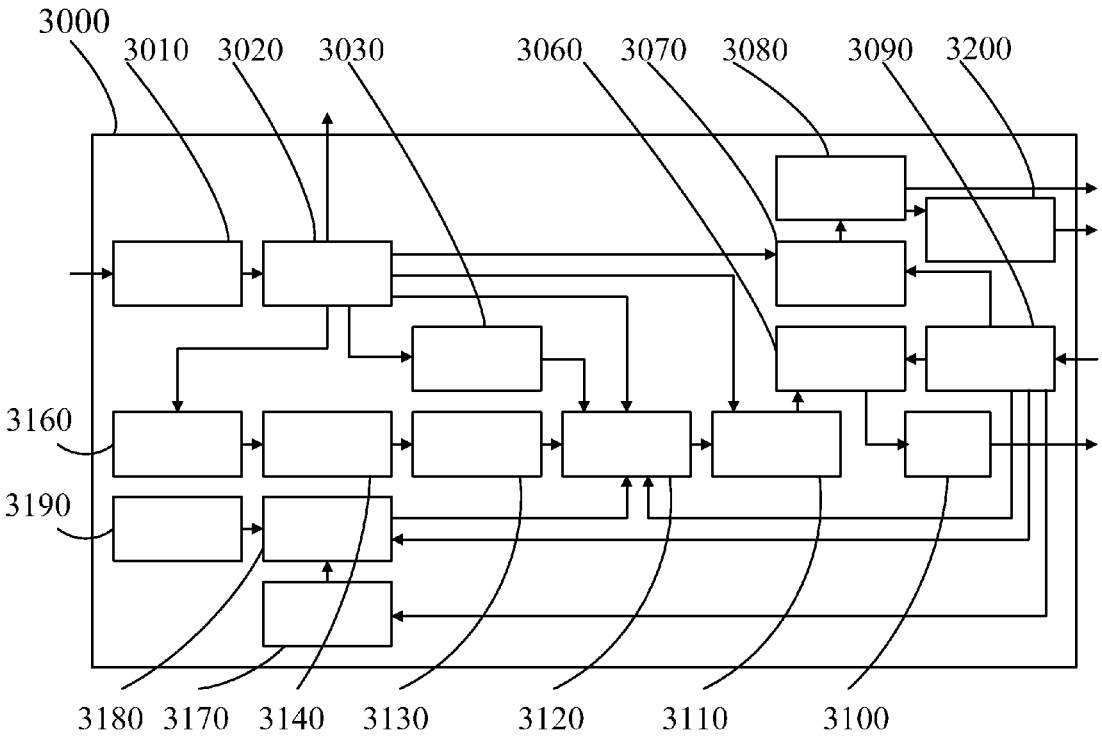
FIG. 3 is an explanatory block diagram showing a detection component of hearing preference of the present invention.

In another embodiment, referring now to FIG. 3, an incoming sound input from an environment monitoring unit 3010 is extracted, wherein said environment monitoring unit 3010 stimulates an environment analyzing unit 3020 to generate a first stream, a second stream, a third stream, a fourth stream, a fifth stream, a sixth stream and a seventh stream. Sequential order of a plurality of stimulation sounds is arranged in a sound sequencing unit 3160, wherein said first stream controls said sound sequencing unit 3160. A first sound is generated in a sound generating unit 3030, wherein said second stream determines a plurality of characteristics of said first sound. Bandwidth of said stimulation sounds is adjusted in a bandwidth adjusting unit 3140, wherein a group delay unit 3130 sound receives a first output of said bandwidth adjusting unit 3140, applies phase spectrum that matches a group delay to generate a first signal, and sends said first signal to a sound mixing unit 3120. Said first signal is mixed with said first sound to generate a mixed signal according to said third stream. A binaural signal is provided for a binaural strategy unit 3110 based on said mixed signal, wherein said fourth stream determines a plurality of characteristics of said binaural signal for a sound manipulating unit 3060. An ear interface unit 3100 is driven according to a first output of a human interface unit 3090, wherein said sound manipulating unit 3060 delivers a third sound to said human interface unit 3090. Said fifth stream is processed in a user-data analyzing unit 3070, wherein said user-data analyzing unit 3070 combines a second output of said human interface unit 3090 with said fifth stream to generate a confidence level. Said confidence level is sent to a confidence level unit 3200 for storage. Said sixth stream is delivered to a result output unit 3080, wherein said result output unit 3080 converts said sixth stream for visual stimulation. An indication is provided to an individual listener through said seventh stream on a plurality of characteristics of time-frequency analysis. A plurality of functions of a platform is identified through a platform identifying unit 3190, wherein said platform identifying unit 3190 transmits said functions to a sound calibrating unit 3180. Finally, said sound mixing unit 3120 is adjusted according to a calibration mode unit 3170, wherein said calibration mode unit 3170 is changed by said human interface unit 3090.

Figure 4:
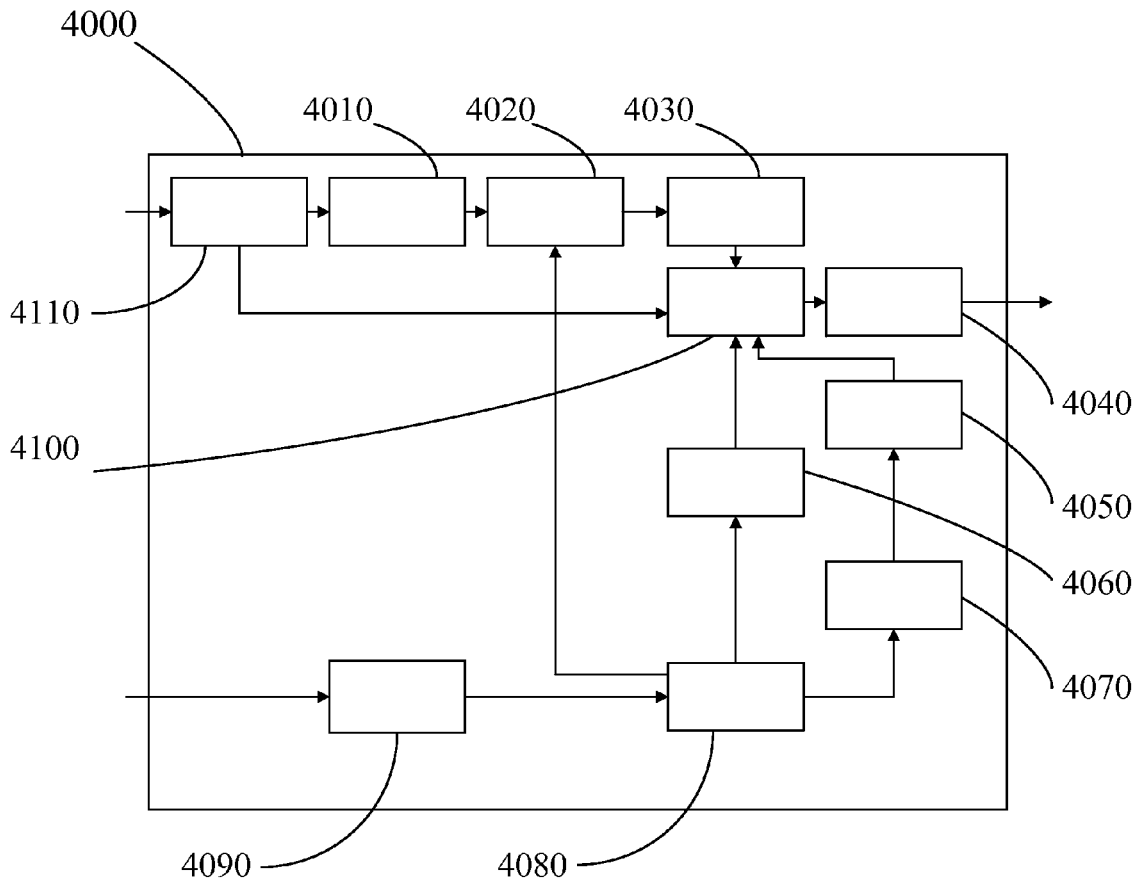
FIG. 4 is an explanatory block diagram showing an individualized personal listening system for sound externalization of the present invention.

In broad embodiment, referring now to FIG. 4, a multi-dimensional reality audio is individualized and delivered, wherein the overall processing is decomposed into a plurality of joint processing units. First, a sensory analysis unit 4100 directs an incoming sound to extract a first stream and classify said sound into one category out of a plurality of categories. Said first stream is processed by a sound combining unit 4010, wherein said sound combining unit 4010 maps a dimension of said first stream to another dimension of a second stream. Said second stream is provided to a sound externalization unit 4020, wherein said sound externalization unit 4020 filters said second stream to increase externalization auditory effect. The output of said sound externalization unit 4020 is transformed through a forward transform unit 4030. Furthermore, a first output of said forward transform unit 4030 is processed by a sound spatialization unit 4110 for a spatial effect according to said category that is determined by said sensory analysis unit 4100. Additionally, a first control signal is obtained through a human input unit 4090 from a listener, wherein said human input unit 4090 converts said first control signal to a second control signal for said sound externalization unit 4020 through a personalization structuring unit 4080. A second output of said sound spatialization unit 4110 passes a reverse transform unit 4040. A magnitude and phase manipulating unit 4060 provides a third control signal to adjust magnitude responses and phase responses of said first output of said forward transform unit 4030 through a personalization structuring unit 4080. A fourth control signal from said personalization structuring unit 4080 is delivered to a dynamic database unit 4070 to extract an individual interaural spatialization response, wherein said individual interaural spatialization response is processed to improve a spatial resolution by a multiple-dimensional interpolation unit 4050.

Multi-modal perception throughout the present invention enhances individual auditory experience. The present invention derives stimuli for various modalities, wherein the derivation targets the fundamental attributes of said stimuli: modality, intensity, location and duration, and aims at affecting multi-cortical areas.

While the invention has been described in connection with various embodiments, it should be understood that the invention is capable of further modifications. This application is intended to cover any variations, uses or adaptation of the invention following, in general, the principles of the invention, and including such departures from the present disclosure as come within the known and customary practice within the art to which the invention pertains.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiments, methods, and examples, but by all embodiments and methods within the scope and spirit of the invention as described herein.

What is claimed is:

1. A sound individualizing system, comprising the steps of: (a) adjusting a sound by an automatic fluctuation control unit; (b) multiplying a plurality of weighting factors with a plurality of data samples of said sound through a sample weighting unit and padding a plurality of zeros by a zero padding unit; (c) transforming a first output of said zero padding unit into a plurality of time-frequency bins by a forward transform unit; (d) passing said time-frequency bins through a cepstrum calculation unit to output a cepstrum; (e) processing said cepstrum by at least one cepstrum-domain lifter; (f) conveying a second output of said lifter into an adaptive classification unit; (g) directing a third output of said forward transform unit to a weighted fusion unit, wherein said weighted fusion unit merges said adjacent time-frequency bins according to human auditory scaling; (h) employing a fourth output of said weighted fusion unit by a long-term moment calculation unit, wherein said long-term moment calculation unit computes a plurality of long-term variance, skewness, kurtosis and higher-order moments; (i) conveying said fourth output of said weighted fusion unit to a short-term moment calculation unit, wherein said short-term moment calculation unit computes a plurality of short-term variance, skewness, kurtosis and higher-order moments; (j) directing said long-term and short-term variances, skewnesses, kurtosises and higher-order moments to said adaptive classification unit; (k) passing said fourth output of said weighted fusion unit to a multi-block weighted averaging unit, wherein said multi-block weighted averaging unit suppresses a plurality of undesired components; (l) calculating a fifth output and a sixth output, wherein said fifth output is a long-term mean value and said sixth output is a short-term mean value; (m) sending said long-term and short-term mean values to said adaptive classification unit, wherein said adaptive classification unit utilizes said cepstrum vector, said long-term and short-term mean values, variances, skewnesses, kurtosises and higher-order moments to classify said sound into a beat category and a non-beat category; (n) converting said beat category and said non-beat category to a beat signal; (o) updating said automatic fluctuation control unit, said sample weighting unit, and said weighting coefficients, wherein said updated weighting coefficients control said multi-block weighted averaging unit to compute said long-term and short-term mean values; and (p) employing said beat signal to enhance auditory perception of an individual listener by an individualized auditory enhancer in accordance to a human input unit.

2. A sound individualizing system according to claim 1, wherein said beat signal drives an individualized multimodal enhancer, and said individualized multimodal enhancer activates at least one tactile actuator.

3. A sound individualizing system, comprising the steps of: (a) generating a first sound in a stimulus generating unit, wherein a sound delivering unit delivers said first sound; (b) extracting a second sound through a sound sensing unit, wherein a sound analyzing unit processes said second sound to output a plurality of time-frequency characteristics; (c) controlling a stimulus searching unit according to said time-frequency characteristics, wherein said stimulus searching unit determines a plurality of stimulus properties; (d) processing said stimulus parameters in said stimulus generating unit to update said first sound and adapt to said sound analyzing unit; (e) switching to a first channel in a channel selecting unit, wherein said sound analyzing unit controls switching, and said first channel is employed by said sound delivering unit in generating said first sound; (f) sending a first control signal from a mode selecting unit to said sound analyzing unit, wherein said mode selecting unit determines operation of said sound analyzing unit, and said sound sensing unit detects a first output of an incoming sound and modifies a second output of said mode selecting unit; and (g) extracting a user input through a human interface unit, wherein said human interface unit determines to latch a third output to a choice storing unit from a plurality of choice units, and said human interface unit controls said mode selecting unit through a user adjustment unit.

4. A sound individualizing system according to claim 3, wherein said first channel are substituted by at least two channels.

5. A sound individualizing system, comprising the steps of: (a) sending a sound input to an input analyzing unit for adapting to quality and amplitude of said sound input; (b) processing a first output of said input analyzing unit through a direct current removing unit to remove direct current components; (c) delivering a second output of said direct current removing unit to a multiplexing unit to pre-process multi-dimensional properties of said sound input for a first forward transform unit; (d) applying a windowing unit to conduct a window function to a third output of said multiplexing unit; (e) padding zeros to a fourth output of said windowing unit through a first zero padding unit; (f) performing a forward transform on a fifth output of said first zero padding unit by said first forward transform unit, whereas said first forward transform unit generates a first transformed stream; (g) delivering said first transformed stream to a beat sensing unit, wherein said beat sensing extracts a beat signal from said first transformed stream; (h) sending said beat signal to a visual animation unit, wherein said visual animation unit stimulates individual visual perception; (i) employing an individual motion sensing unit to detect an individual motion, wherein said individual motion unit stimulates an individual motion conversion unit; (j) conveying a converted motion waveform from said individual motion conversion unit to said visual animation unit, a spatial data loading unit, an equalization curve searching unit, and a filter shaping unit, wherein said spatial data loading unit loads a transformed frequency response of a spatial impulse response to a channel arranging unit, said equalization curve searching unit searches for an equalization curve for an individual, and said filter shaping unit adjusts a response contour of a function combining unit; (k) sending a sixth output of a test result converter unit to said function combining unit, wherein said test result converter unit extracts a seventh output of a hearing test unit; (l) providing a combined stream from said test result converter, said equalization curve searching unit, and said filter shaping unit to a first reverse transform unit, wherein said first reverse transform unit conducts a reverse transform; (m) delivering an eighth output of said first reverse transform unit to a second zero padding unit, wherein said second zero padding unit pads zeros to said eighth output of said first reverse transform unit; (n) conveying a second stream combined from said spatial data loading unit, said beat sensing unit, and a second forward transform unit, wherein said second forward transform unit conducts a forward transform on a ninth output of said second zero padding unit; (o) delivering said second stream to a magnitude and phase manipulating unit, where said magnitude and phase manipulating unit adjusts magnitude and phase of said first stream; and (p) sending a tenth output of said magnitude and phase manipulating unit to a second reverse transform unit for enhancing auditory perception.

6. A sound individualizing system, comprising the steps of: (a) sending a sound to a sensory analysis unit for extracting a first stream and classifying said sound; (b) processing said first stream to a sound combining unit, wherein said sound combining unit maps a plurality of dimensions of said first stream to a plurality of dimensions of a second stream; (c) providing said second stream to a sound externalization unit, wherein said sound externalization unit filters said second stream to enhance externalization auditory effect; (d) performing a forward transform to a first output of said sound externalization unit through a forward transform unit; (e) conveying a spatialization effect to a second output of said forward transform unit through a sound spatialization unit, wherein said sound spatialization unit adjusts spatialization based on said classification of said sensory analysis unit; (f) obtaining a first control signal from a listener through a human input unit, wherein said human input unit converts said first control signal to a second control signal to said sound externalization unit through a personalization structuring unit; (g) providing a third control signal to a magnitude and phase manipulating unit to adjust magnitude responses and phase responses of said second output of said forward transform unit through said personalization structuring unit; (h) delivering a fourth control signal from said personalization structuring unit to a dynamic database unit to extract an individual interaural spatialization response, wherein said individual interaural spatialization response is processed to improve a spatial resolution by a multiple-dimensional interpolation unit; and (i) conducting a reverse transform to a third output of said sound spatialization unit through a reverse transform unit.

7. A sound individualizing system, comprising the steps of: (a) sending a sound to an input adapting unit for extracting a first stream; (b) processing said first stream in a forward transform unit, wherein said forward transform unit performs a forward transform to generate a transformed signal; (c) delivering said transformed signal to a magnitude and phase manipulating unit, wherein said magnitude and phase manipulating unit adjusts magnitude and phase of said transformed signal; (d) extracting an individual input in an individual interface unit, wherein said individual interface unit stimulates a time-frequency analysis unit to generate a time-varying and frequency-selective signal for a low frequency effect unit; (e) sending an adjusting signal from said low frequency effect unit to said magnitude and phase manipulating unit; and (f) analyzing said first stream in a music analyzing unit to classify said first stream, wherein said low frequency effect unit is controlled according to said classification.

8. A sound individualizing system, comprising the steps of: (a) extracting a sound through a sound acquiring unit, wherein said sound acquiring unit delivers a first stream; (b) processing said first stream in an environment analyzing unit and an automatic range adjustment unit, wherein said automatic range adjustment unit is controlled by said environment analyzing unit; (c) conveying a first output of said automatic range adjustment unit to a re-centering unit, where said re-centering unit is controlled by a fine structure unit to deliver a second stream to a re-scaling unit; (d) scaling time-domain resolution of said second stream through said re-scaling unit, wherein said re-scaling unit is adjusted by said fine structure unit; (e) processing a second output of said re-scaling unit in a time-frequency analysis unit, wherein said time-frequency analysis unit analyzes time-variation and frequency-selectivity of said second output and delivers a third output to an individual output unit; (f) delivering said third output to a sound classifying unit, wherein said sound classifying unit controls said individual output unit; (g) extracting a human input from a human interface unit, where said human interface unit stimulates said environment analyzing unit, said fine structure unit, a time-frequency distribution unit, a weighting unit; (h) processing said human input in said time-frequency distribution unit, wherein said time-frequency distribution unit determines transform kernel functions of said time-frequency analysis unit; (i) employing said weighting unit to control said individual output unit; and (j) storing an instantaneous status of said individual output unit to a status storing unit, wherein said human interface unit retrieves said instantaneous status from said status storing unit.

9. A sound individualizing system, comprising the steps of: (a) extracting a sound input from an environment monitoring unit, where said environment monitoring unit stimulates an environment analyzing unit to generate a first stream, a second stream, a third stream, a fourth stream, a fifth stream, a sixth stream and a seventh stream; (b) arranging sequential order of a plurality of stimulation sounds stored in a sound sequencing unit, wherein said first stream controls said sequential order; (c) generating a first sound in a sound generating unit, wherein said second stream determines a plurality of characteristics of said first sound; (d) adjusting bandwidth of said stimulation sounds in a bandwidth adjusting unit, wherein a group delay unit sound receives a first output of said bandwidth adjusting unit, applies phase spectrum that matches a group delay to generate a first signal, and sends said first signal to a sound mixing unit; (e) mixing said first signal with said first sound to generate a mixed signal according to said third stream; (f) providing a binaural signal for a binaural strategy unit based on said mixed signal, wherein said fourth stream determines a plurality of characteristics of said binaural signal for a sound manipulating unit; (g) driving an ear interface unit according to a second output of a human interface unit, wherein said sound manipulating unit delivers a second sound to said ear interface unit; (h) controlling said sound manipulating unit by said human interface unit, wherein said human interface unit interfaces with an individual listener; (i) processing said fifth stream in a user-data analyzing unit, wherein said user-data analyzing unit combines a third output of said human interface unit with said fifth stream to generate a confidence level; (j) sending said confidence level to said confidence level unit for storage; (k) delivering said sixth stream to a result output unit, wherein said result output unit converts said sixth stream for visual stimulation; (l) providing an indication to an individual listener through said seventh stream on a plurality of characteristics of time-frequency analysis; (m) identifying a plurality of functions of a platform through a platform identifying unit, wherein said platform identifying unit transmits said functions to a sound calibrating unit; and (n) adjusting said sound mixing unit according to a calibration mode unit, wherein said calibration mode unit is changed by said human interface unit.

10. A sound individualizing system, comprising the steps of: (a) extracting a sound input through an automatic gain control unit, wherein said automatic gain control unit transmits a gain-adjusted signal to a windowing unit; (b) conducting a forward transform in a forward transform unit, wherein said forward transform unit receives a windowed signal from said windowing unit; (c) calculating and performing magnitude adjustment in a magnitude manipulating unit, wherein said magnitude manipulating unit sends a magnitude-adjusted signal to a group delay manipulating unit; (d) remapping a plurality of frequency components from a first output of said group delay manipulating unit, wherein a frequency remapping unit transmits a remapped signal to a reverse transform unit; (e) extracting a second input of an individual listener through a human interface unit, wherein said human interface unit activates a hearing test unit to collect individual information of said listener's hearing, and said magnitude manipulating unit is controlled by said hearing test unit for generating said magnitude-adjusted signal; (f) analyzing said individual information in a test rating unit, wherein said test rating unit determines a third output of a response optimizing unit to adjust said magnitude manipulating unit and said group delay manipulating unit; (g) sending said sound input to an environment analyzing unit, wherein said environment analyzing unit calculates to control said automatic gain control unit, and adaptively generates a first control signal to said magnitude manipulating unit, and a second control signal to said group delay manipulating unit; (h) providing phase compensation in said group delay manipulating unit, wherein said hearing test unit conducts said phase compensation for generating a group delay according to said response optimizing unit; (i) detecting a type of a hearing device, whereas said type is used as an index to look up a device compensation library; (j) conducting a magnitude and phase compensation in a response compensation unit, wherein said response compensation unit extracts a fourth output of said device compensation library; and (k) obtaining a user input through a peripheral selecting unit and a peripheral compensation library, wherein a fifth output of said peripheral compensation library controls said response compensating unit jointly with said device compensation unit.

11. A sound individualizing system, comprising the steps of: (a) conducting a forward transform of a sound in a forward transform unit, wherein said forward transform unit sends a plurality of channels to a channel selection unit; (b) providing a first output from said channel selection unit to a magnitude manipulating unit, wherein magnitude of said first output is changed according to a first control signal of an equalization library unit; (c) sending a second output from said magnitude manipulating unit to a phase manipulating unit, wherein phase of said second output is changed to output a third output according to a second control signal of said equalization library unit; (d) conducting a reverse transform of said third output in a reverse transform unit; (e) extracting a user input through a human interface unit, wherein said user input controls a search criterion unit; (f) sending a fourth output from said search criterion unit to a selection result unit, wherein said selection result unit determines said first and second control signals of said equalization library unit; and (g) controlling a plurality of user choice units for said human interface unit to select a fifth output, wherein said fifth output is latched into said selection result unit.

12. A sound individualizing system, comprising the steps of: (a) conducting a forward transform of a sound in a forward transform unit, wherein said forward transform unit sends a first output to a range selection unit; (b) selecting a plurality of frequency ranges through said range selection unit, wherein a range table unit provides a look-up table for said range selection unit; (c) conducting analysis of correlation between a plurality of channels through a cross-channel analysis unit, wherein said cross-channel analysis unit delivers a second output to a metric accumulating unit; (d) computing a metric to quantize said correlation and generate a third output, wherein said third output is stored into a metric optimization unit, and said metric optimization unit is controlled by an iteration control unit; (e) adjusting said frequency ranges according to a fourth output of said metric optimization unit, wherein said iteration control unit determines storage depth of said third output; and (f) sending signal components that reside outside said frequency ranges to a reverse transform unit, wherein a fifth output of said reverse transform unit is mixed with a sixth output of a target removing unit, and said target removing unit extracts said sixth output by removing a target component from said sound.

* * * * *